United States Patent [19]

Benham

[11] 4,356,950

[45] Nov. 2, 1982

[54] EASY ACCESS DISPENSING CARTON WITH DUST BARRIER

[75] Inventor: Albert A. Benham, Granville, Mass.

[73] Assignee: Champion International Corporation, Stamford, Conn.

[21] Appl. No.: 257,276

[22] Filed: Apr. 24, 1981

[51] Int. Cl.[3] ..... B65D 5/22; B65D 5/62; B65D 5/72

[52] U.S. Cl. ..... 229/11; 229/7 R; 206/443; 221/307

[58] Field of Search ..... 229/7 R, 17 S, 20, 32, 229/34, 40, 11, 19; 221/63, 307, 310; 206/443, 555

[56] References Cited

U.S. PATENT DOCUMENTS

| | | | |
|---|---|---|---|
| 2,078,018 | 4/1937 | Parnell | 229/34 R |
| 2,124,335 | 7/1938 | Klein | 229/34 R |
| 2,407,919 | 9/1946 | Buttery | 229/7 R |
| 2,598,050 | 5/1952 | Guyer | 229/17 S |
| 3,083,866 | 4/1963 | Strange | 221/63 |
| 3,155,273 | 11/1964 | Cote | 221/63 |
| 3,193,137 | 7/1965 | McCarthy | 221/63 |
| 3,261,501 | 7/1966 | Capucio | 221/309 |
| 3,684,084 | 8/1972 | Kanzelberger | 229/19 |

FOREIGN PATENT DOCUMENTS

| | | | |
|---|---|---|---|
| 287821 | 4/1953 | Switzerland | 221/63 |
| 110271 | 10/1917 | United Kingdom | 229/11 |
| 690187 | 4/1953 | United Kingdom | 221/62 |
| 1382183 | 1/1975 | United Kingdom . | |

*Primary Examiner*—Herbert F. Ross
*Attorney, Agent, or Firm*—Evelyn M. Sommer

[57] ABSTRACT

A two-piece paperboard carton including a tray portion having an open top for receiving a plurality of articles, such as cotton swabs. A rectangular cover sleeve is slid over the tray portion so as to retain the swabs within the tray. The sleeve includes a generally elliptically-shaped opening substantially closed by a transparent, plastic sheet which is spaced from opposite score lines of the sleeve and is perforated along a line or seam perpendicular to the adjacent score lines. In order to gain access to the cotton swabs and dispense the same from the tray, the film is separated into two halves along the perforated seam. Upon removal of a swab from the tray through the seam in the film, the film will return to its initial position to create a dust barrier for the swabs remaining in the tray.

4 Claims, 9 Drawing Figures

Fig. 5.
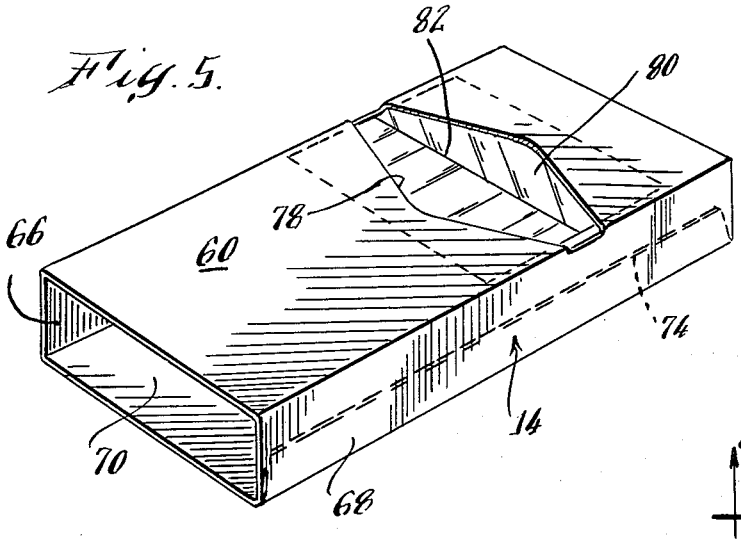
Fig. 6.
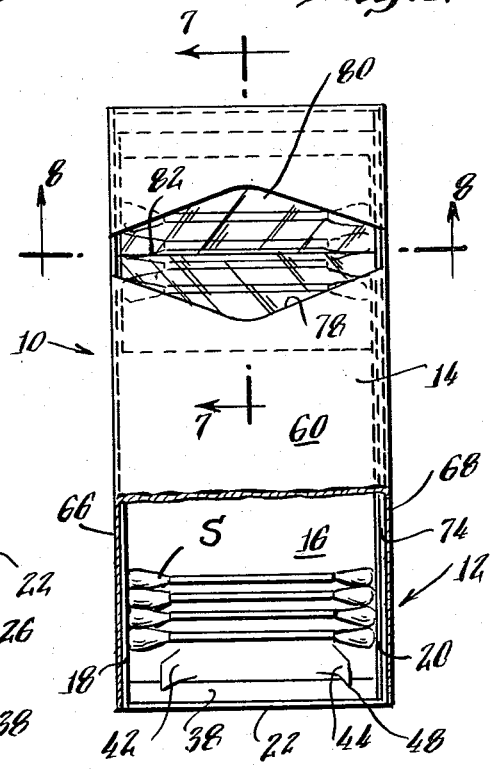
Fig. 7.
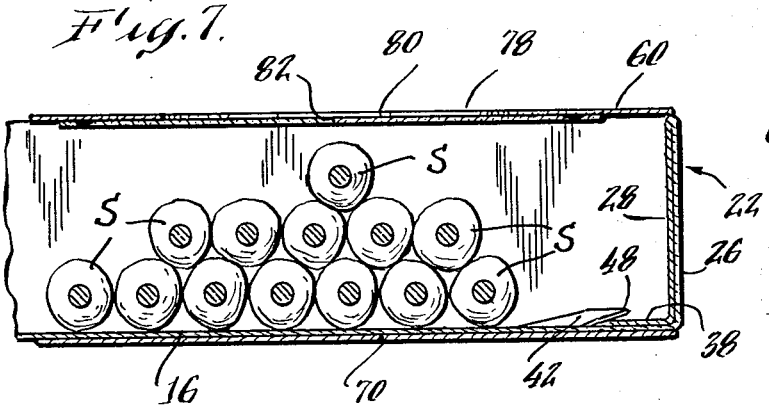
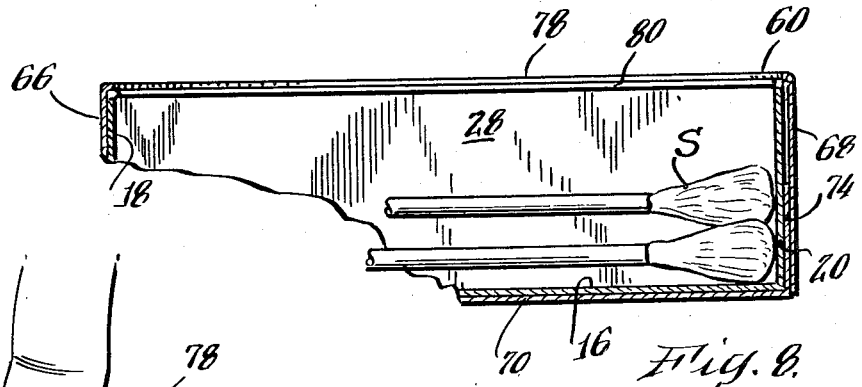
Fig. 8.
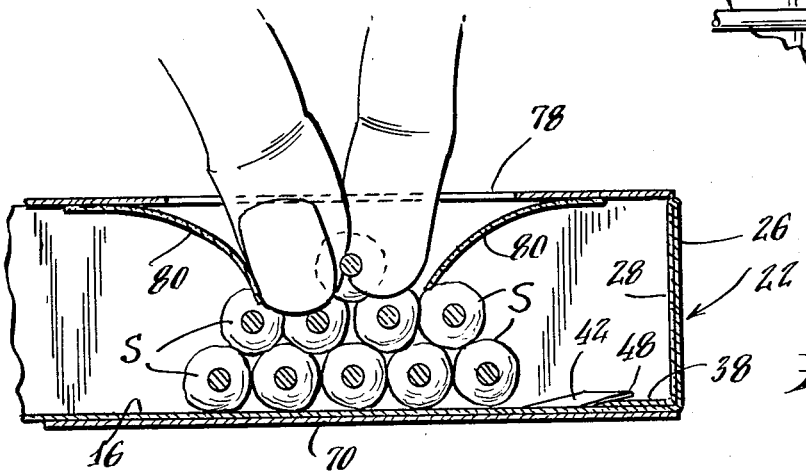
Fig. 9.

EASY ACCESS DISPENSING CARTON WITH DUST BARRIER

BACKGROUND OF THE INVENTION

1. Field of the Invention

This invention relates to an easy access dispensing carton and more particularly, a carton provided with a transparent window serving as a dust barrier through which one or more articles housed within the carton can be dispensed.

2. Description of the Prior Art

U.S. Pat. No. 4,139,121, issued to the same assignee as the assignee of the present invention, illustrates a dispensing carton in which a transparent window is provided with a seam or line of perforation extending substantially perpendicular to the carton side walls. The window enables viewing of the articles within the carton and can be split along the seam to dispense articles such as cotton swabs, therethrough.

However, the transparent window or film is glued along the opposed scored or folded portions of the carton so that when an article such as a cotton swab is desired to be removed from the carton, the swab must be tilted at an angle to the carton bottom and carefully manipulated to remove the same from the carton interior. Otherwise, the transparent window is subject to be torn along its attachment to the opposed score lines along the top of the carton, precluding the transparent window from being reused as an effective barrier for the remainder of the articles housed within the carton. In any event, upon separation of the seam or line of perforation, the attachment of each portion of the window to opposed score lines of the top cover is usually severed or ruptured, causing a permanent opening to be established into the interior of the carton. This defeats one purpose of the provision of the transparent window, that is, to provide an effective seal or dust barrier for the remaining articles housed within the interior of the carton.

SUMMARY OF THE INVENTION

This invention relates to an easy access dispensing carton provided with a transparent window on an outer cover sleeve thereof which includes a centrally located perforated seam in a transparent window which extends perpendicular to the major dimension of the sleeve. The sleeve includes an opening which is substantially elliptical in shape and the transparent window covers the elliptical opening along the top panel thereof. The transparent window is substantially rectangular in shape and is glued about the elliptical opening in the top surface of the sleeve along the bottom surface of the top of the sleeve in such a manner that the opposed edges of the transparent film are spaced inwardly from opposed lateral edges of the sleeve.

Upon tearing the transparent film along the perforated score line, the transparent film is severed in half and can be bent inwardly into the sleeve and away from each other to provide access to articles housed within an inner tray received in the sleeve. Each of the articles can be removed through the opening formed by the severed halves of the film and since the film is not connected along opposed edges to adjacent portions of the sleeve, the film is adapted due to its own resiliency to repivot to a closed position housing the articles within the tray received within the outer sleeve, to provide an effective seal and dust barrier.

The inner tray portion of the carton for holding the articles includes opposed side and end panels. The end panels are foldable 180° back upon themselves and have a horizontally extending tab extending along the bottom of the tray which is adapted to cooperate with tabs struck from the interior of the bottom surface of the tray to lock the horizontal tabs, and end and side panels of the tray in a substantially rectangular parallelopiped configuration with an open top to receive articles such as cotton swabs.

The outer sleeve is then slid over the inner tray portion to form the completed carton.

BRIEF DESCRIPTION OF THE DRAWINGS

Further objects and advantages of the invention will become apparent from the following description and claims, and from the accompanying drawings, wherein:

FIG. 5 is a perspective view of the outer sleeve component of the carton of the present invention formed from the blank of FIG. 2;

FIG. 6 is a top plan view, partly broken away in section, of the assembled carton of the present invention;

FIG. 7 is a cross-sectional view of the carton of FIG. 6 taken substantially along the plane indicated by line 7—7 of FIG. 6;

FIG. 8 is a cross-sectional view of the carton of FIG. 6 taken substantially along the plane indicated by line 8—8 of FIG. 6; and FIG. 9 is a cross-sectional view similar to FIG. 7, but illustrating the manner of removing an article from the interior of the carton.

DETAILED DESCRIPTION OF THE PREFERRED EMBODIMENT

Figure 1:
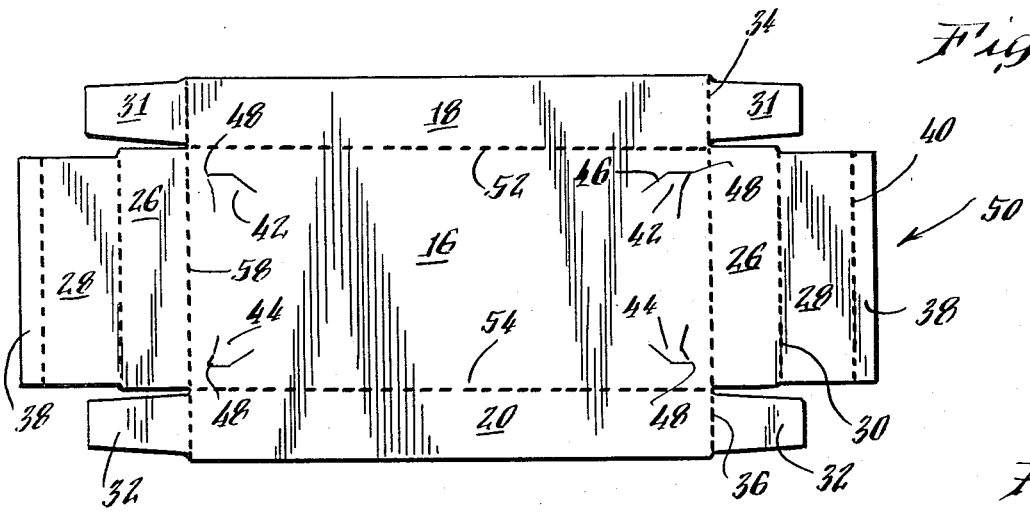
FIG. 1 is a plan view of a blank for forming the inner tray component of the carton of the present invention.

Referring now to the drawings in detail, wherein like numerals indicate like elements throughout the several views, the dispensing carton 10 of the present invention includes an inner tray portion 12 and an outer substantially rectangular parallelopiped sleeve portion 14.

Figure 4:
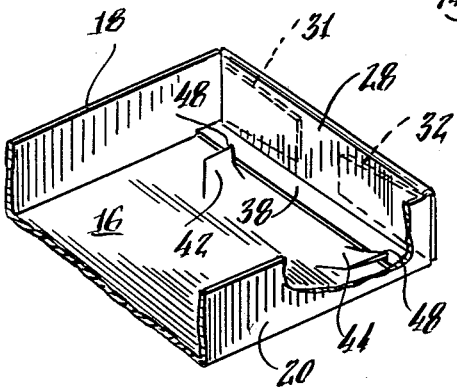
FIGS. 3 and 4 are perspective views illustrating the manner of folding the blank of FIG. 1 to form the inner tray component of the carton of the present invention.
Figure 3:
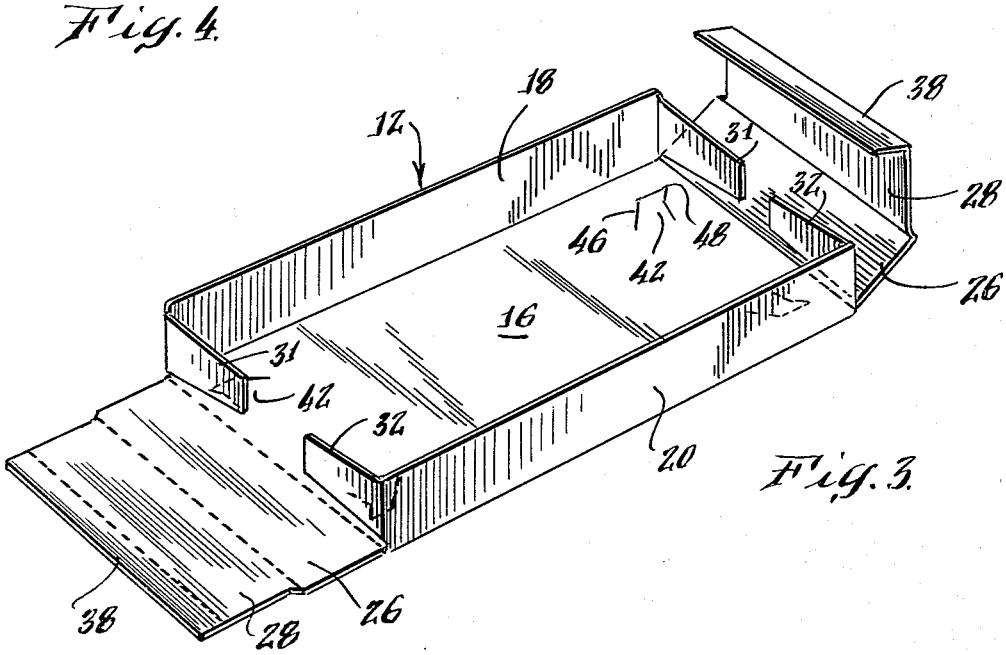

The tray 12 includes a bottom wall 16, a pair of opposed side walls 18 and 20 pivotally connected to the bottom wall 16 and an opposed pair of end walls 22 pivotally connected to the opposed smaller edges 58 of the bottom wall 16. Each of the end walls 22 includes an outer panel 26 foldably connected to an inner panel 28 adapted to be pivoted 180° with respect to panel 26 about a fold line 30 between the panels into overlying relation with respect thereto, as illustrated in FIGS. 3 and 4. In between overlying panels 26 and 28 are disposed a pair of tabs 31 and 32, which are pivotally connected along fold lines 34 and 36, respectively, to the opposite smaller edges of the side walls 18 and 20, respectively.

A tab 38 is connected by a perforated score line 40 to the bottom edge of each inner end wall panel 28 and is adapted to overlie the bottom panel 16 of the tray 12. A pair of tabs 42 and 44 are adapted to be struck from the plane of the bottom wall 16 along cut lines 46 upwardly from the plane of the bottom wall 16 and include portions 48 adapted to extend toward the tabs connected to the end walls. Portions 48 of each of tabs 42 and 44 are disposed over the tab 38 to lock the same in place in substantially coplanar relation to bottom wall 16 and retain the tray 12 in a substantially rectangular parallelopiped configuration with an open top.

As illustrated in FIG. 1 the tray 12 is formed from a blank generally designated by numeral 50.

Blank 50 includes bottom wall panel 16 foldably connected by horizontal score lines 52 and 54 to side wall panels 18 and 20, respectively. The outer end wall panels 26 are connected by score lines 58 to the opposed horizontal edges of bottom panel 16. An inner end wall panel 28 is connected by a score line 30 to the remaining edge of panel 26 and a tab 38 are connected to the opposite edge of each panel 28 by the perforated score line 40.

The tray 12 is first formed by folding the side panels 18 and 20 about score lines 52 and 54 respectively, 90° so that they assume a substantially upright position relative to bottom wall panel 16. Side tabs 31 and 32 are then folded 90° about their respective score lines 34 and 36 and outer end wall panel 26 folded about score line 58 to a substantially upright position perpendicular to bottom wall panel 16. Inner end wall panels 28 are then each folded 180° about score line 30 so as to overly an outer end wall panel 26 and side wall tabs 31 and 32 are disposed between each of the end wall panel pairs 26 and 28. Each end wall tab 38 is then disposed at 90° relative to inner end wall panel 28 in parallel relation with bottom wall panel 16. Locking tabs 42 and 44 are struck from the bottom wall 16 and portions 28 are caused to overly each of the tabs 38 to retain the tray in a substantially rectangular parallelopiped configuration with an open top. Articles, such as cotton swabs S can then be placed within the interior of the tray and enclosed by outer sleeve 14.

Figure 2:
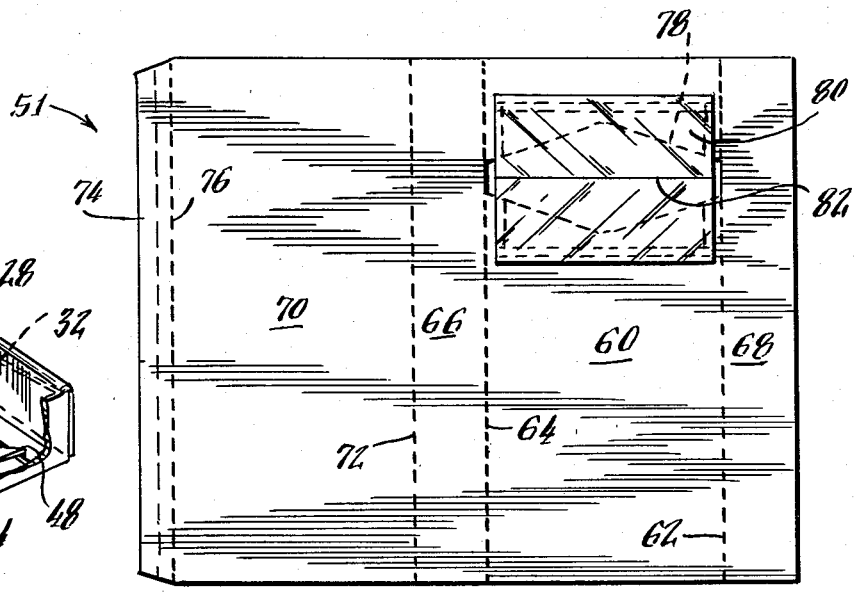
FIG. 2 is a plan view of a blank for forming the outer sleeve component of the carton of the present invention.

Outer sleeve 14 is formed from blank 51 as shown in FIG. 2 and has a top rectangular panel 60 foldably connected by vertical score lines 62 and 64 to side rectangular panels 66 and 68, respectively. A bottom rectangular panel 70 is connected by vertical score line 72 to side panel 66 and is folded into parallel relation to top panel 60, as illustrated in FIG. 5. The free edge of bottom panel 70 is connected by score line 76 to a glue flap 74 which is adhesively connected to the inner surface of side panel 68 to form the complete rectangular sleeve. The sleeve 14 is slid over and around tray 12 as shown in FIGS. 6 to 8 to form the carton 10.

The top panel 60 of sleeve 14 is provided with a substantially elliptical opening 78. The opening 78 provides access to the articles, such as cotton swabs S disposed within the tray 12 so that they can be removed from the tray without sliding the tray 12 relative to the sleeve 14. Further, the articles can be viewed at the time of purchase by a prospective purchaser.

The opening 78 is closed by a substantially transparent plastic film 80 which is glued to the lower surface of the top panel 60 of sleeve 14 on opposite top and bottom sides of the elliptical opening 78. However, the opposed edges of film 80 adjacent score lines 62 and 64 of top surface 60 of sleeve 14 are spaced inwardly from the score lines so that only the terminal ends of the lateral edges of the film are adhered to the lower surface of panel 60.

A perforated score line 82 is provided in sleeve 80 and substantially bisects the film 80. Perforated score line 82 extends perpendicular to score lines 62 and 64 defining the lateral edges of the top panel 60 of sleeve 14. In order to gain access to the interior of the tray 12 through opening 78, the transparent film 80 is ruptured along the perforated score line of seam 82 and the resultant halves of the transparent film pivoted down into the tray away from each other as illustrated in FIG. 9 to provide an opening through which one or more of the swabs S can be grasped and removed from the tray 14.

Because the opposite edges of the film 80 are spaced inwardly from the score lines 62 and 64, the transparent film is not ruptured along its opposed edges when opened, and can pivot by its own resiliency to a closed position wherein each half of the film will abut each other along the severed perforated seam 82 to reclose the opening 78 and provide an effective dust barrier for the interior of the tray 14.

What is claimed as new is as follows:

1. A two piece substantially rectangular carton for housing and dispensing elongated articles, said articles being disposed perpendicular to a major lengthwise dimension of the carton, said carton comprising;

an open top tray portion including a bottom wall, a pair of opposed side walls extending upwardly from said bottom wall, and a pair of opposed end walls extending upwardly from said bottom wall between opposed end portions of said side walls, said end walls of said lower tray portion includes a panel bent back upon itself to define an inner and outer end wall panel, a tab connected to the inner end wall panel disposed to overlie said bottom wall, and at least one locking tab in said bottom wall adjacent each of said end wall tabs for overlying the same and locking the same to said bottom wall, and an open ended sleeve adapted to be slid over said tray portion to substantially enclose the same, said sleeve including:

a top wall having an upper and lower surface a bottom wall, and a pair of opposed side walls between said top and bottom wall, said top wall of said sleeve including an opening therethrough extending entirely thereacross and providing access to the interior of said tray so that one of the elongated articles adapted to be housed within said tray can be removed from said tray through said access opening, and a resilient transparent film connected to the lower surface of said top wall panel of said sleeve in such a manner that opposed side edges thereof are spaced slightly inwardly from the opposed lateral edges of said top wall, said film adhesively connected to the lower surface of said top wall only along the upper and lower edges thereof and adjacent the top and bottom edges of said opening, said film including a perforated score line substantially bisecting the film and extending substantially perpendicular to the opposed lateral edges of the top panel of said sleeve.

2. The carton of claim 1 wherein said opening in said sleeve is substantially elliptical in shape and the transparent film is substantially rectangular.

3. The carton of claim 2 wherein each of the side walls of the tray portion of said carton includes a tab pivotally connected to opposed edges thereof received between each pair of said inner and outer end wall panels.

4. The carton of claim 3 wherein said sleeve and tray are formed from paperboard material.

* * * * *